US005370508A

United States Patent [19]

Barthod et al.

[11] Patent Number: 5,370,508

[45] Date of Patent: Dec. 6, 1994

[54] POSITIVE-DISPLACEMENT MACHINE HAVING ORBITAL MOTION

[75] Inventors: Benoît Barthod, Cran-Gevrier; Jean-Pierre Chicerie, Annecy Le Vieux; Denis Perrillat Amede, Annecy, all of France

[73] Assignee: Alcatel Cit, Paris, France

[21] Appl. No.: 217,054

[22] Filed: Mar. 24, 1994

[30] Foreign Application Priority Data

Apr. 2, 1993 [FR] France ..... 93 03906

[51] Int. Cl.[5] ..... F04B 17/00

[52] U.S. Cl. ..... 417/410.3; 418/61.3

[58] Field of Search ..... 417/410 B, 355, 356; 418/61.3

[56] References Cited

U.S. PATENT DOCUMENTS

| | | | |
|---|---|---|---|
| 2,561,890 | 7/1951 | Stoddard | 417/410 B |
| 2,703,370 | 3/1955 | Steensen . | |
| 2,965,039 | 12/1960 | Morita . | |
| 4,233,003 | 11/1980 | Jeng | 418/61.3 |
| 4,639,202 | 1/1987 | Mahanay et al. | 417/355 |
| 5,145,329 | 9/1992 | Zumbusch et al. . | |

FOREIGN PATENT DOCUMENTS

| | | | |
|---|---|---|---|
| 0539273 | 4/1993 | European Pat. Off. | 418/61.3 |
| 4209607A1 | 8/1992 | Germany . | |
| 556474 | 11/1974 | Switzerland . | |
| 1681050 | 9/1991 | U.S.S.R. | 418/61.3 |

OTHER PUBLICATIONS

Japanese Patent Abstract JP 2169889 dated Jun. 29, 1990.

*Primary Examiner*—Richard A. Bertsch
*Assistant Examiner*—M. Kocharov
*Attorney, Agent, or Firm*—Sughrue, Mion, Zinn, Macpeak & Seas

[57] ABSTRACT

The machine includes a piston which is cylindrical in the mathematical sense, which has an axis $\Delta_p$, which is rotary, and which is situated in a cylindrical casing that has an axis $\Delta_c$, the piston having an outline that has $\Delta_p$ axes of symmetry, the casing delimiting a hollow volume whose cross-section in a plane perpendicular to its axis $\Delta_c$ has $S_c$ axes of symmetry, $S_p$ and $S_c$ differing from each other by unity. The axes $\Delta_p$ and $\Delta_c$ are parallel and are separated by a distance E, the piston and the casing delimiting at least three chambers between them, and the casing including at least one suction inlet and one delivery outlet. The positive-displacement machine further includes a ferromagnetic sprocket which has an axis $\Delta_p$, which is secured to the piston, which has $N_p$ teeth, and which is disposed inside a ferromagnetic toothed ring which has an axis $\Delta_c$ and which is secured to the casing, the toothed ring being provided with $N_B$ electrical windings disposed radially, wherein the ratio $N_p/N_B$ is equal to the ratio $S_p/S_c$, and wherein the $N_B$ electrical windings of the toothed ring are powered successively.

8 Claims, 9 Drawing Sheets

POSITIVE-DISPLACEMENT MACHINE HAVING ORBITAL MOTION

The present invention relates to a positive-displacement machine having orbital motion.

BACKGROUND OF THE INVENTION

Machines of that type are known, e.g. Document DE 42 09 607 describes a positive-displacement machine including a rotor which has an approximately figure-of-eight shape, i.e. the shape of a rotor of a Roots pump, and which describes orbital motion inside a stator: the axis of the rotor describes a circle, while the rotor also rotates in the opposite direction about its own axis. The stator has an outline presenting three lobes forming three chambers, each of which is provided with an intake valve and with a delivery valve.

However, such machines require eccentric drive mechanisms for providing the orbital motion, with bearings, etc. and therefore require lubricated mechanisms.

OBJECTS AND SUMMARY OF THE INVENTION

An object of the invention is to provide drive apparatus for driving machines having orbital motion, without mechanical bearings, and therefore being suitable for dry machines.

The invention therefore provides a positive-displacement machine having orbital motion and including a piston which is cylindrical in the mathematical sense, which has an axis $A_p$, which is rotary, and which is situated in a cylindrical casing that has an axis $\Delta_c$, said piston having a cross-section that has $S_p$ axes of symmetry in a plane perpendicular to its axis $\Delta_p$, said casing delimiting a hollow volume whose cross-section in a plane perpendicular to its axis $\Delta_c$ has $S_c$ axes of symmetry, $S_p$ and $S_c$ differing from each other by unity, the axes $A_p$ and $\Delta_c$ being parallel and separated by a distance E, the piston and the casing delimiting at least three chambers between them, and the casing including at least one suction inlet and one delivery outlet, wherein said positive-displacement machine further includes a ferromagnetic sprocket which has an axis $\Delta_p$, which is secured to the piston, which has $N_p$ teeth, and which is disposed inside a ferromagnetic toothed ring which has an axis $\Delta_c$ and which is secured to the casing, said toothed ring being provided with $N_B$ electrical windings disposed radially, wherein the ratio $N_p/N_B$ is equal to the ratio $S_p/S_c$, and wherein the $N_B$ electrical windings of said toothed ring are powered successively.

In a preferred embodiment, providing entirely friction-free operation, the machine further includes a wheel which has an axis $\Delta_p$, which is secured to the piston, and which has a radius $R_1=S_pE$, said wheel being disposed inside and rolling without slip inside a circular bore which has an axis $\Delta_c$ and is provided in a support that is secured to said toothed ring, the bore having a radius $R_2=S_cE$.

In another embodiment, in which the eccentricity E is large, corresponding to the piston and the casing having large dimensions, the ferromagnetic sprocket is flanked by two rolling rings of radius $R_1=S_pE$ and the ferromagnetic toothed ring is flanked by two rolling paths of radius $R_2=S_cE$, the radii of the sprocket and of the toothed ring being such that there is a small amount of clearance between the sprocket and the toothed ring on the generator line corresponding at all times to rolling contact without slip between said rolling rings and said rolling paths.

The invention also provides a positive-displacement machine having orbital motion and including a piston which is cylindrical in the mathematical sense, which has an axis $\Delta_p$, which is rotary, and which is situated in a cylindrical casing that has an axis $\Delta_c$, said piston having a cross-section that has $S_p$ axes of symmetry in a plane perpendicular to its axis $\Delta_p$, said casing delimiting a hollow volume whose cross-section in a plane perpendicular to its axis $\Delta_c$ has $S_c$ axes of symmetry, $S_p$ and $S_c$ differing from each other by unity, the axes $\Delta_p$ and $\Delta_c$ being parallel and separated by a distance E, the piston and the casing delimiting at least three chambers between them, and the casing including at least one suction inlet and one delivery outlet, wherein said positive-displacement machine further includes a ferromagnetic collar which has an axis $\Delta_p$, which has an outside diameter $D_1$, which is secured to the piston, and which is disposed inside a ferromagnetic toothed ring which has an axis $\Delta_c$, which has an inside diameter $D_2$, and which is secured to the casing, said toothed ring being provided with a plurality of electrical windings disposed radially and powered successively, the ratio $D_1/D_2$ being different from the ratio $S_p/S_c$, a small amount of clearance existing between those respective generator lines of the collar and of the toothed ring which are closest together and which are situated in the plane containing the axes $\Delta_p$ and $\Delta_c$, and wherein the machine further includes a wheel which has an axis $\Delta_p$, which is secured to the piston, and which has a radius $R_1=S_pE$, said wheel being disposed and rolling without slip inside a circular bore which has an axis $\Delta_c$, and which is provided in a support that is secured to said toothed ring, the bore having a radius $R_2=S_cE$.

According to another characteristic, the machine includes an axial magnetic abutment composed of at least one pair of magnetized rings, one of which is secured to the fixed portion, and the other of which is secured to the moving portion.

BRIEF DESCRIPTION OF THE DRAWINGS

The invention is described below with reference to the accompanying drawings, in which.

MORE DETAILED DESCRIPTION

Figure 1:
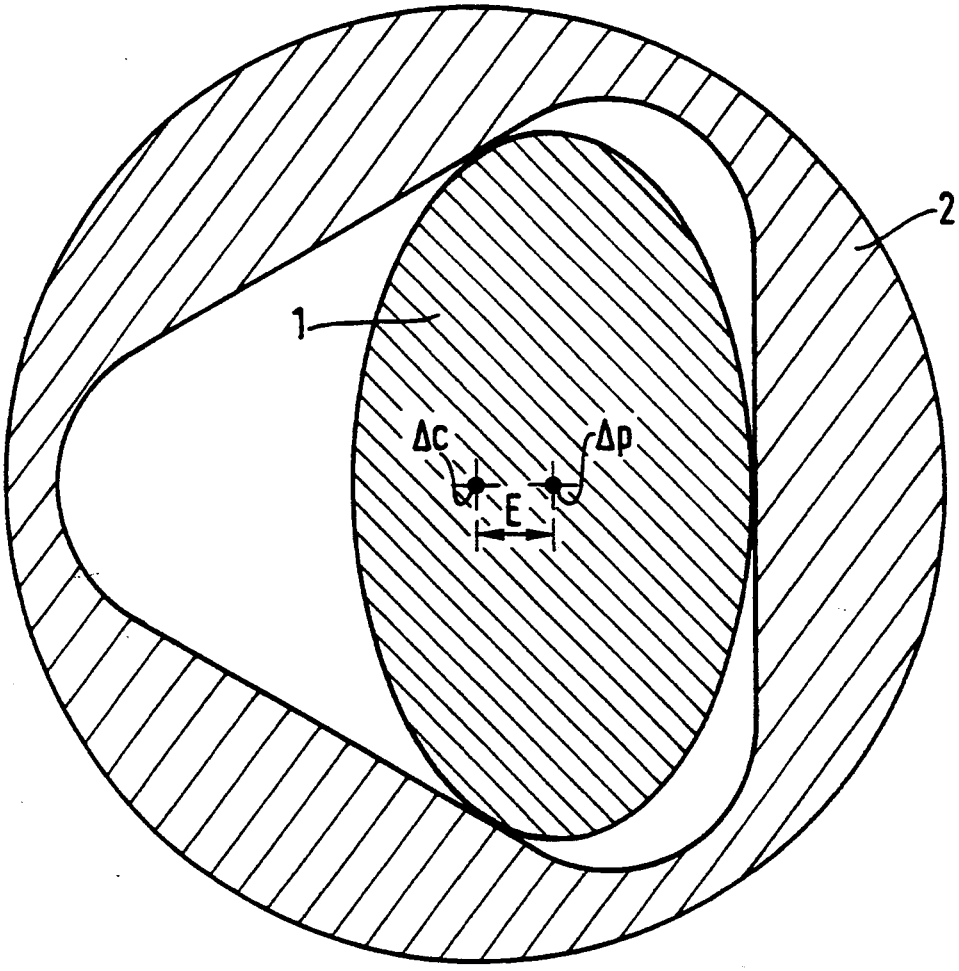
FIGS. 1, 2, and 3 show three outlines chosen from the numerous possible piston and casing outlines of the invention.

Prior to the specific description of the drawings, there follows a general description of the machine. Such a machine comprises a cylindrical piston having an axis $\Delta_p$, and a cylindrical casing having an axis $\Delta_c$. The axes $\Delta_p$ and $\Delta_c$ are parallel and are a distance E apart.

The term "cylindrical" is used herein in its broad mathematical sense; with neither the piston nor the casing necessarily being in the form of a right circular cylinder. In the machine, the cylinder defining the shape of the piston has an order of symmetry about its axis $\Delta_p$ equal to $S_p$, whereas the cylinder of the casing has an order of symmetry equal to $S_c$; with $S_p$ and $S_c$ being chosen so that they differ from each other by unity. Furthermore, the geometrical shapes of the piston and of the casing are chosen so that the two elements correspond directly to each other.

One of the elements (i.e. the casing or the piston) has an outline $P_1$ which corresponds to a curve uniformly distant from a closed hypertrochoid, having no crunodes and no cusps, excluding hypertrochoids that are degraded into hypotrochoids, epitrochoids, or peritrochoids. The outline $P_1$ may also be at zero distance from such a hypertrochoid, and may therefore correspond thereto. Hypertrochoids are defined in French Patent 2,203,421. The other element has an outline $P_2$ which is the envelope of $P_1$ in relative orbital motion defined by two circles $C_1$ and $C_2$ having respective centers and radii ($O_1$, $R_1$) and ($O_2$, $R_2$), the circles being respectively secured to the outlines $P_1$ and $P_2$, and rolling on each other without slip via internal contact. The centers $O_1$ and $O_2$ of the two circles $C_1$ and $C_2$ are situated on the axes $\Delta_p$ and $\Delta_c$, and the eccentricity of the circles is $E=|O_1O_2|$ corresponding to the distance between the two axes $\Delta_p$ and $\Delta_c$.

Machines satisfying those characteristics may be grouped into four families depending on the nature of the element whose shape is defined by $P_1$, and depending on the comparative values of the radii $R_1$ and $R_2$. The following should be distinguished:

machines for which $P_1$ is the outline of the piston and $P_2$ is the outline of the casing, which outline corresponds to the outer envelope of $P_1$ in the orbital motion of $P_1$ relative to $P_2$, for which $R_1=S_pE$ and $R_2=S_cE=(S_p+1)E$ (family I);

machines for which $P_1$ is the outline of the piston and $P_2$ is the outline of the casing, which outline corresponds to the outer envelope of $P_1$ in the orbital motion of $P_1$ relative to $P_2$, for which $R_1=S_pE$ and $R_2=S_cE=(S_p-1)E$, where $S_p>1$ (family II);

machines for which $P_1$ is the outline of the casing and $P_2$ is the outline of the piston, which outline corresponds to the inner envelope of $P_1$ in the orbital motion of $P_1$ relative to $P_2$, for which $R_2=S_pE$ and $R_1=S_cE=(S_p-1)E$ where $S_p>1$ (family III); and machines for which $P_1$ is the outline of the casing and $P_2$ is the outline of the piston, which outline corresponds to the inner envelope of $P_1$ in the orbital motion of $P_1$ relative to $P_2$, for which $R_2=S_pE$ and $R_1=S_cE=(S_p+1)E$ (family IV).

Other machines may be derived from machines belonging to any one of the four preceding families. An outline $P_2$ may be used, having at least one portion corresponding to the envelope $P_1$ in its motion relative to $P_2$, and at least one portion outside the envelope in the case of families I or II, and inside the envelope in the case of families III or IV, the various portions connecting together to define a closed curve.

The outlines of the piston and of the casing of such a machine offer the advantage of being machinable by mass-production machines (lathe-type machines), and this reduces the cost of the piston and of the casing.

More precisely, the following description given with reference to the above-listed figures relates to a particularly advantageous group of machine outlines belonging to the above-defined family I and whose piston outlines $P_1$ satisfy the following equation in the complex plane:

$$Z_1 = \frac{1+S}{2} E \cdot e^{i\frac{k}{S}(1-S)} + R_m e^{i\frac{k}{S}} + \frac{1-S}{2} E \cdot e^{i\frac{k}{S}(1+S)}$$

in which equation, $Z_1$ designates the complex number designating the generator point of the outline $P_1$, each point being indicated by a particular value of the dynamic parameter k which varies over the range 0 to $2S\pi$ for a single pass along the curve, S is an integer which designates the order of symmetry of $P_1$ about the origin of the complex plane, and it is chosen arbitrarily, and E and $R_m$ are two lengths chosen freely providing that the corresponding curve has no crunodes and no cusps, thereby indirectly limiting the value of the ratio $E/R_m$.

One of the advantages of these machines is that, when the outline $P_1$ of the piston satisfies the above equation, the outline $P_2$ of the casing, which is the envelope of $P_1$ in the relative orbital motion, also satisfies that equation.

FIG. 1 is a section through a piston and a casing on a plane that is perpendicular to the respective parallel axes $\Delta_p$ and $\Delta_c$ of the piston 1 and of the casing 2, showing the outlines of the piston and of the casing.

The outlines, $P_1$ for the piston 1 and $P_2$ for the casing 2, satisfy the above equation, with a piston 1 having an order of symmetry $S_p=2$ and a casing 2 having an order of symmetry $S_c=3$. E is the distance between the axes $\Delta_p$ and $\Delta_c$.

Figure 2:
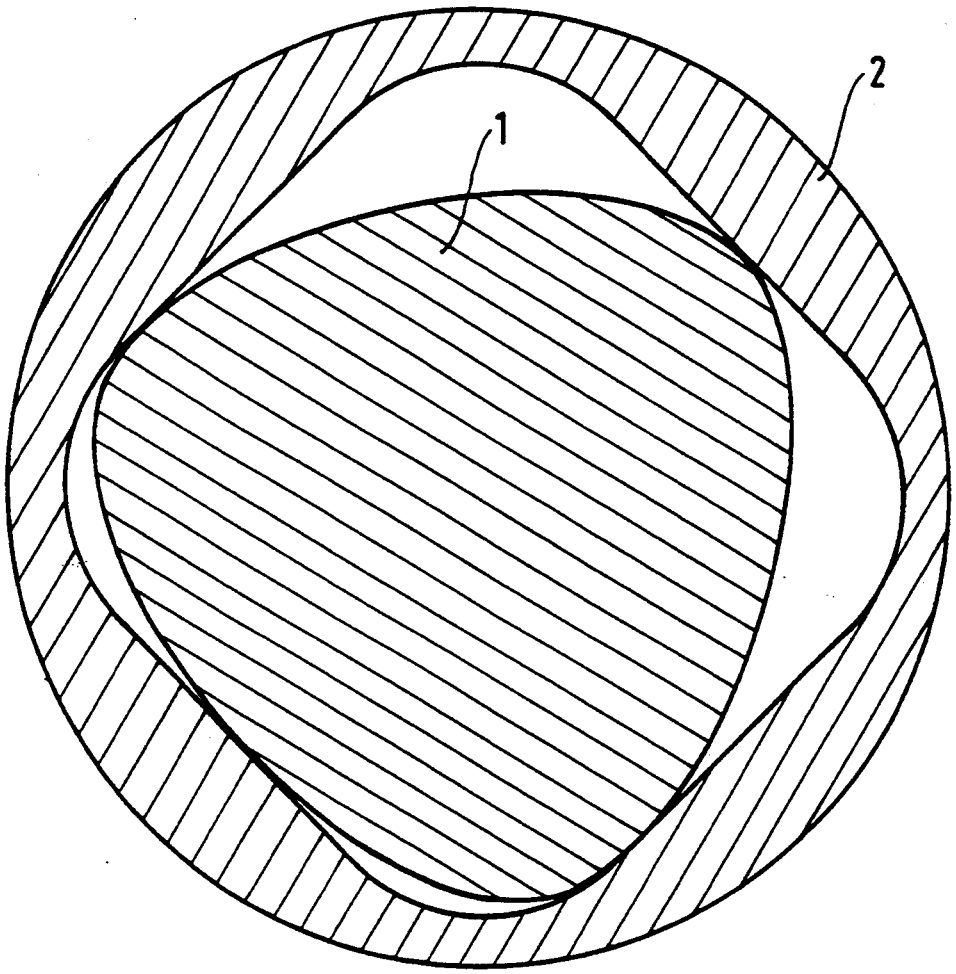

FIG. 2 is a view similar to that of FIG. 1, but in the case where the piston 1 has an order of symmetry $S_p=3$ and the casing 2 has an order of symmetry $S_c=4$.

Figure 3:
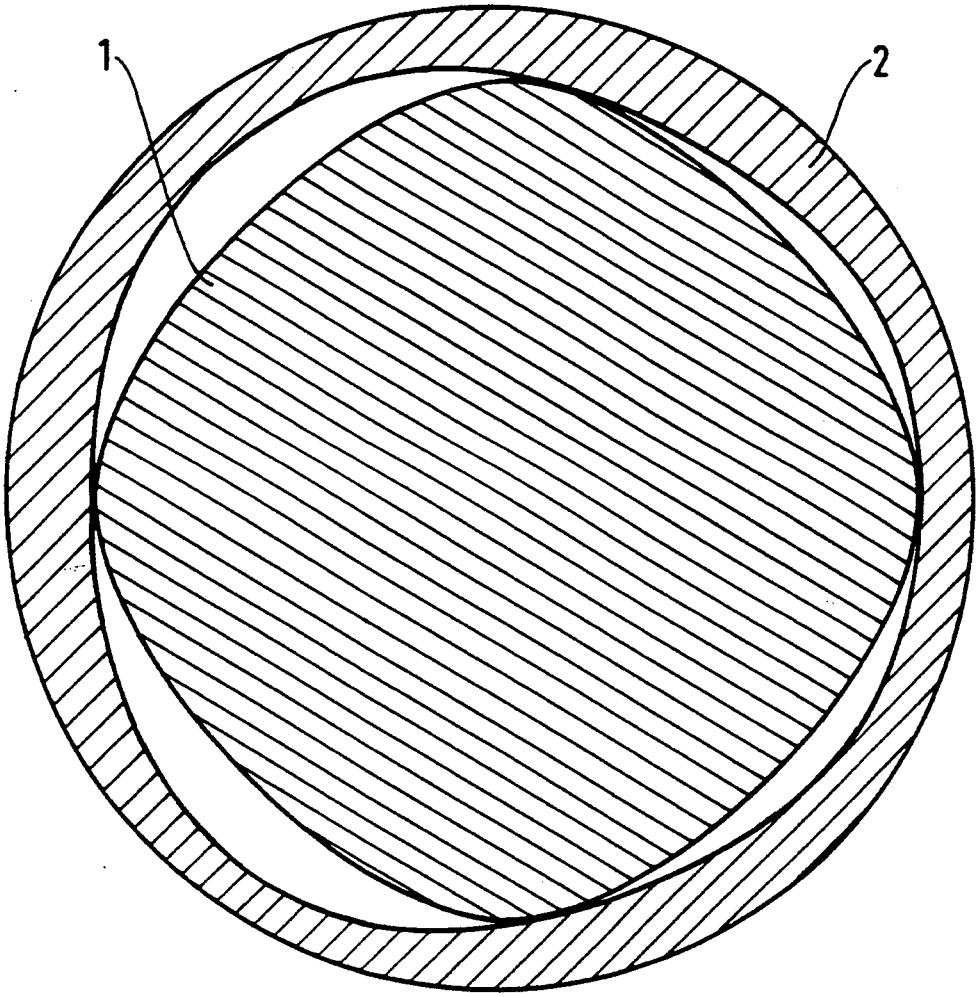

FIG. 3 shows another example in which the piston 1 has an order of symmetry $S_p=4$ and the casing 2 has an order of symmetry $S_c=3$.

It should be noted that the number of axes of symmetry is equal to the order of symmetry.

Those three figures correspond to piston and casing outlines satisfying the above equation.

In the machines of the invention shown in the following figures, given by way of non-limiting example, a piston having two axes of symmetry $S_p=2$ and a casing having three axes of symmetry $S_c=3$ have been chosen.

Figure 5:
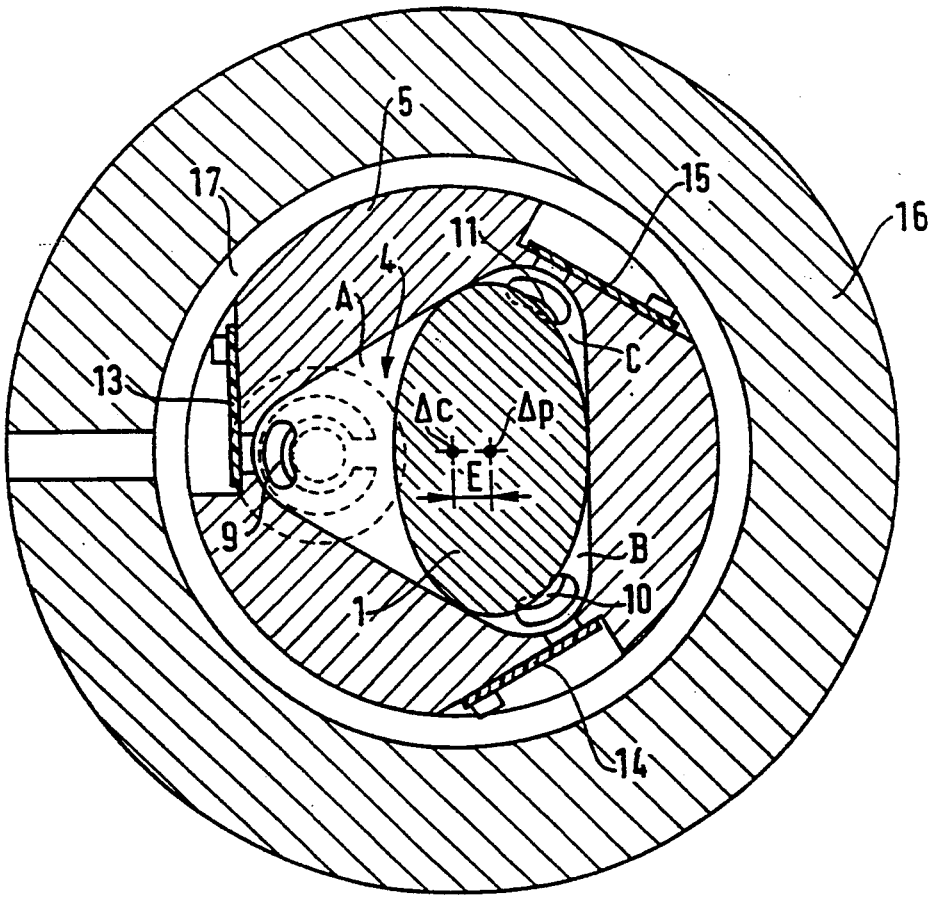
FIG. 5 is a section on V—V of FIG. 4.
Figure 6:
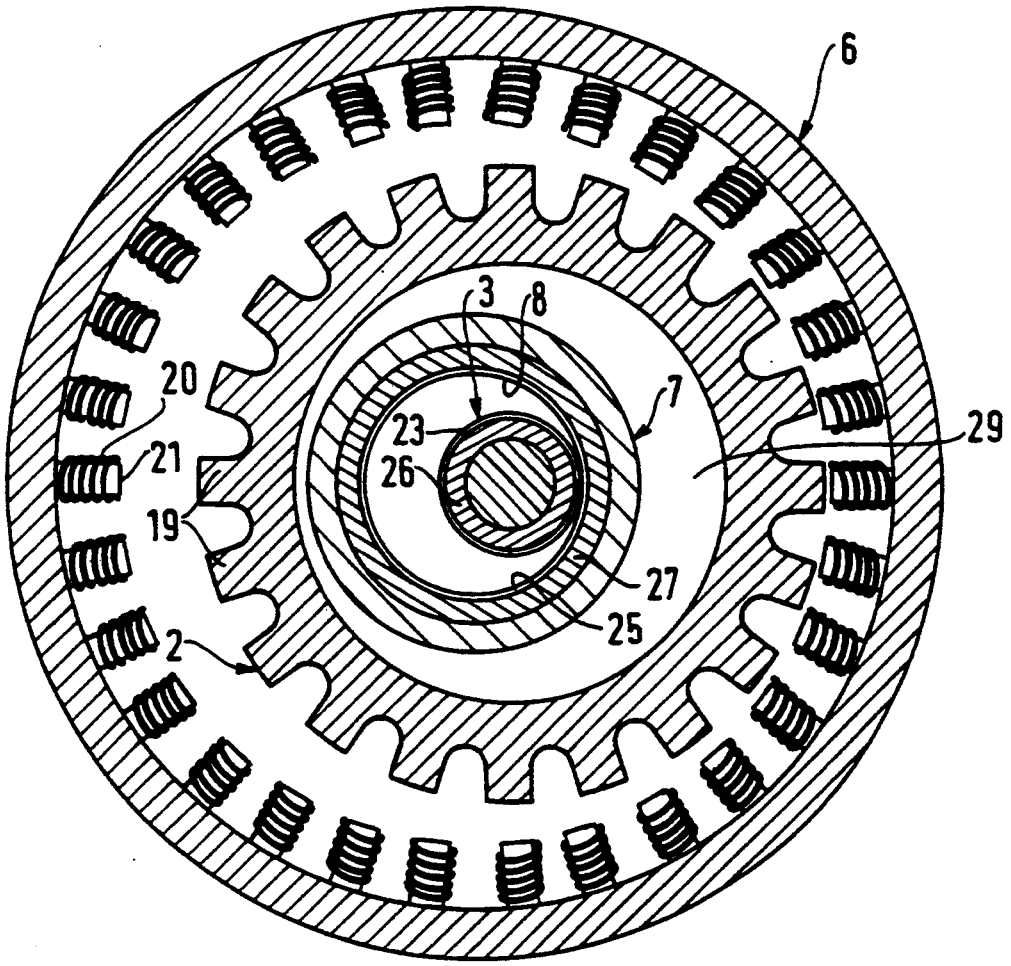
FIG. 6 is a section on VI—VI of FIG. 4.

A machine of the invention is described below with reference to FIGS. 4, 5, and 6.

The machine shown includes a rotor portion which has an axis $\Delta_p$ and which comprises a cylindrical piston 1, a ferromagnetic sprocket 2, and a wheel 3, and a stator portion which has an axis $\Delta_c$, and which includes a pumping unit constituting a hollow volume 4 inside a casing 5, a ferromagnetic toothed ring 6, and a support 7 provided with a bore 8.

In a plane perpendicular to its axis $\Delta_p$, the piston 1 has a hypertrochoidal geometrical shape having an outline $P_1$ which corresponds to the equation given above, and which has two axes of symmetry: $S_p=2$. The piston is situated in the casing 5 which has an axis $\Delta_c$ and which encloses the hollow cylindrical volume 4 whose cross-section has an outline $P_2$ which also corresponds to the above equation, and which has parallel and are separated by a distance E.

The piston 1 and the casing 2 delimit three chambers A, B, and C, each of which is provided with an intake provided with a valve, respectively 9, 10, and 11, and situated in a cheek 12 secured to the stator portion, and an exhaust provided with a valve, respectively 13, 14, and 15. A body 16 in the shape of a toothed ring surrounds the casing 5 and contains a circular recess 17 which channels the three exhausts towards a single delivery orifice 18.

During operation, the piston 1 moves in orbital motion inside the casing 5: the axis $\Delta_p$ describes a circle of radius E about the fixed axis $\Delta_c$ of the casing while the piston itself rotates about its own axis $\Delta_p$.

During the rotation of the piston in orbital motion, the volume of each chamber A, B, and C increases and decreases alternately in a pumping motion.

The orbital motion is produced by the sprocket 2 and the toothed ring 6. To this end the ferromagnetic sprocket 2, which has an axis $\Delta_p$ and which is secured to the piston 1, is provided with $N_p$ teeth 19, and is situated inside the ferromagnetic toothed ring 6 which has an axis $\Delta_c$, which is secured to the casing 5, and which is provided with $N_B$ electrical windings 20. The ratio $N_p/N_B$ is equal to the ratio $S_p/S_c$. The windings 20 are powered successively. In this way, the successive teeth 19 of the sprocket 2 are successively attracted by the successive windings 20 successively powered, thereby causing the sprocket to roll with slip inside the toothed ring 6. It is to be understood by the fact that the windings are powered successively that the windings may be powered successively one-by-one, or that a plurality of successive windings may be powered simultaneously and that the next winding in a simultaneously-powered group is successively powered while the first winding in that group is no longer powered. The rolling takes place with slip because the ratio of the radius of the sprocket 2 to the radius of the toothed ring 6 (at the ends of the teeth 19 on the sprocket 2 and at the ends of the poles 21 carrying the windings 20) is different from the ratio of the number $N_p$ of teeth 19 on the sprocket 2 to the number $N_B$ of windings 20 on the toothed ring 6. However the ratio $N_p/N_B$ is equal to the ratio $S_p/S_c$, i.e. to the ratio between the radii of the above-defined circles $C_1$ and $C_2$, which radii have respective values: $R_1=S_pE$ and $R_2=S_cE$, the circle $C_1$ rolling without slip inside the circle $C_2$ with the motion of the piston 1 of outline $P_1$ inside the casing 5 whose hollow volume is the outline $P_2$ corresponding to the envelope of $P_1$ in the orbital motion of $C_1$ inside $C_2$.

In this way, by the sprocket 2 rolling with slip inside the toothed ring 6, where the ratio of the teeth on the sprocket to the electrical windings on the toothed ring is $S_p/S_c$, the required motion of the piston 1 inside its casing 5 is obtained. However, in order to obtain motion without friction and thereby to avoid any need for lubrication, the circles $C_1$ and $C_2$ are physically embodied by said wheel 3 and by the bore 8 in the support 7 secured to the stator portion. In this way, the wheel 3 has a radius $R_1=S_pE$, and the bore 8 has a radius $R_2=S_cE$. The wheel 3 rolls inside the bore 8 via rolling rings 22, 23 carried by the wheel and via rolling rings 24, 25 on the support 7.

The rolling rings 22, 23 on the wheel 3 and the rolling rings 24, 25 on the support 7 flank an axial magnetic abutment constituted by two magnetic rings, namely one magnetic ring 26 carried by the wheel 3, and another magnetic ring 27 carried by the support 7. The rings are magnetized axially in opposite directions so as to attract each other. They are slightly set back relative to the respective levels of the rolling rings.

In the example described: $S_p=2$ and $S_c=3$; $N_p=20$ and $N_B=30$, and $N_p/N_B=Sp/S_c=\frac{2}{3}$.

For frictionless operation, a very small amount of clearance exists between the sprocket 2 and the toothed ring 6. In the same way, there is a very small amount of operating clearance between the piston 1 and the casing 5, which clearance may result from the machine being run in.

Figure 7:
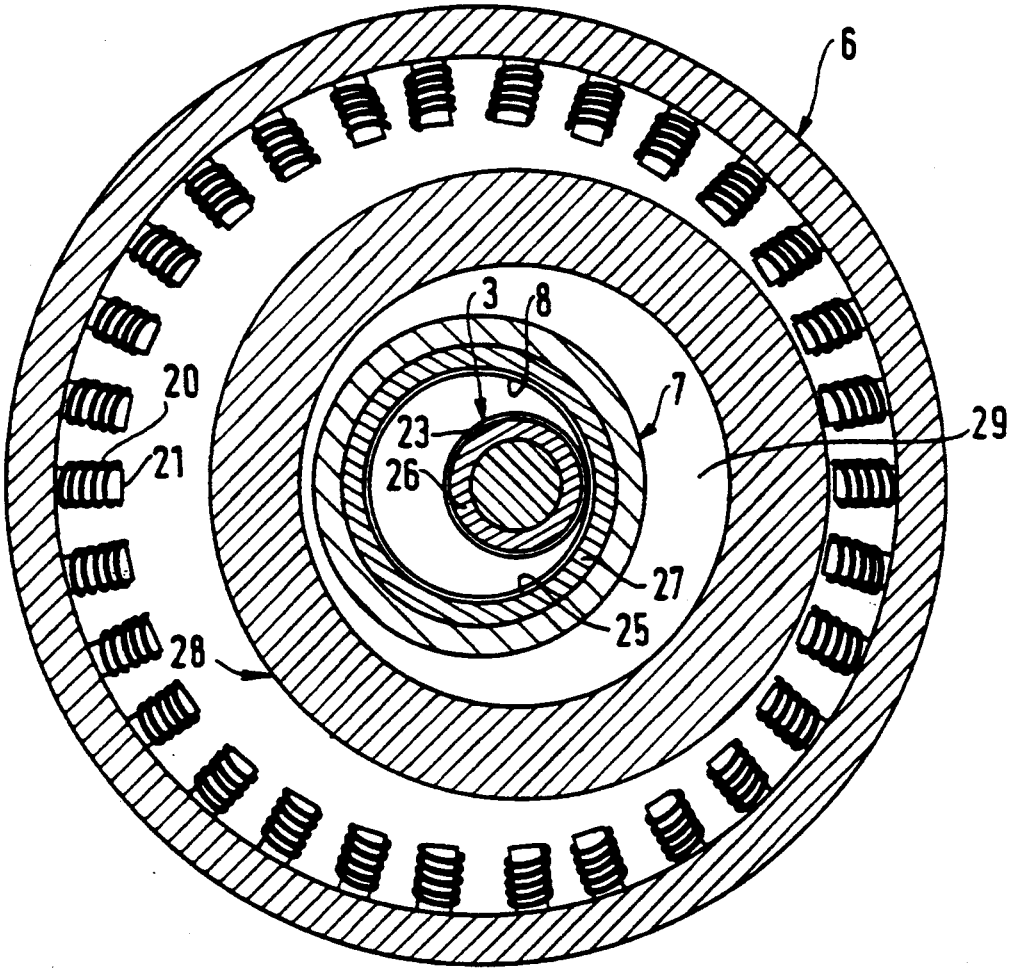
FIG. 7 is a view corresponding to FIG. 6, showing a variant in which the sprocket is replaced merely by a ferromagnetic ring.

FIG. 7 shows a variant of the invention. FIG. 7 is equivalent to FIG. 6 and only differs therefrom in that the sprocket 2 is replaced merely by a toothless ferromagnetic ring 28. The diameters $D_1$ and $D_2$ of the toothless ring 28 and of the toothed ring 6 are such that $D_1/D_2$ is different from $S_p/S_c$, a small amount of clearance also existing between the toothed ring and the toothless ring. In this example, the rolling motion without slip is not produced, as it is in the preceding example, by successive attraction of teeth towards the successively-powered windings due to the fact that the ratio of the number of teeth on the sprocket to the number of windings on the toothed ring is different from the ratio between the radii of the sprocket and of the toothed ring, but rather, in this example, the rolling motion of the toothless ring 28, with slip, inside the toothed ring 6 is imparted merely by the contact of the wheel 3 in the bore 8, and the absence of contact between the toothless ring 28 and the toothed ring 6. Therefore, the parts in contact with each other roll with slip (the wheel 3 in the bore 8), and the toothless ring 28 is thus free to "roll" without slip since there is no contact. As in the preceding example, the electrical windings 20 are powered successively.

Figure 8:
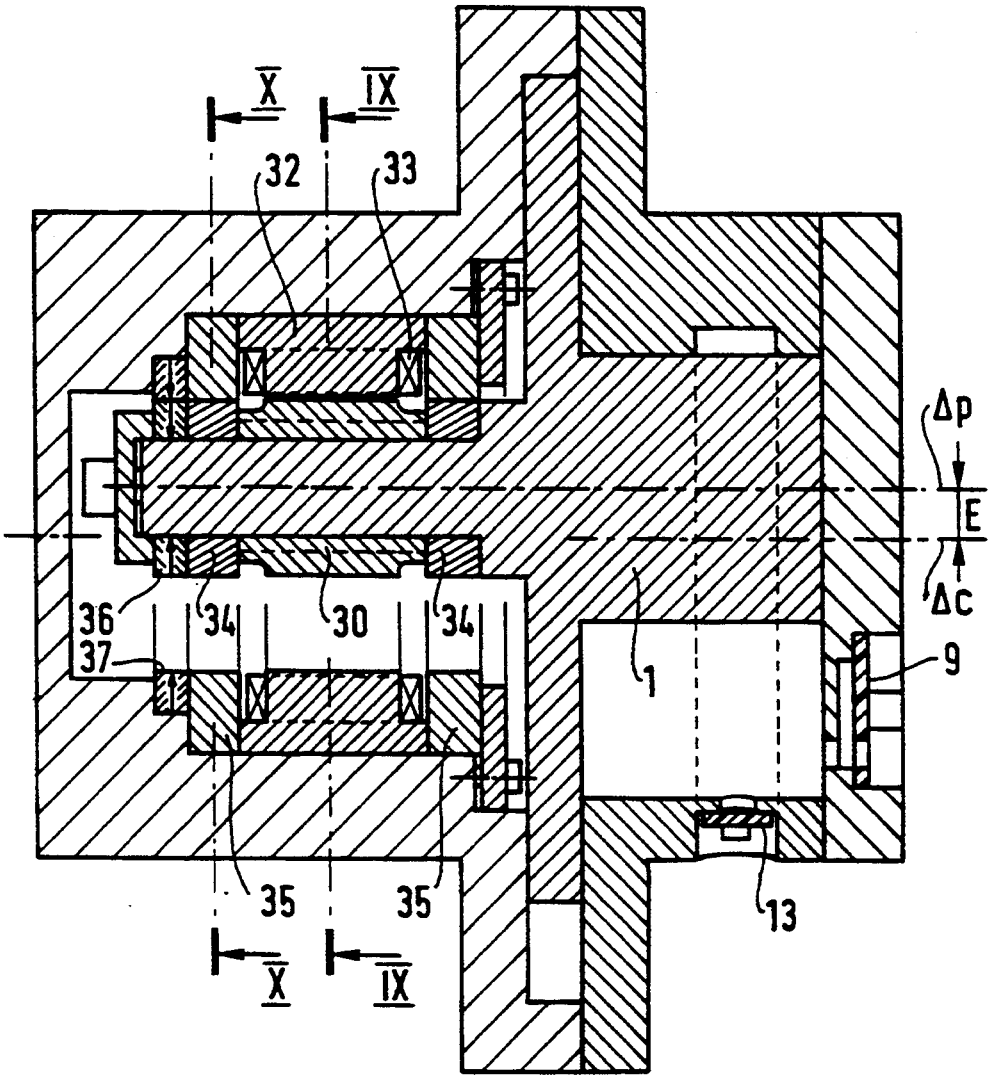
FIG. 8 is a view corresponding to FIG. 4 and showing a variant.
Figure 9:
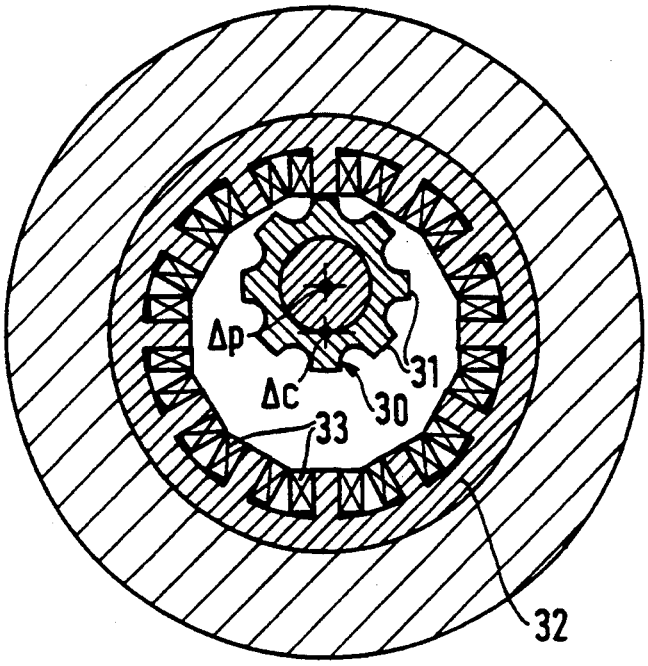
FIG. 9 is a section on IX—IX of FIG. 8.
Figure 10:
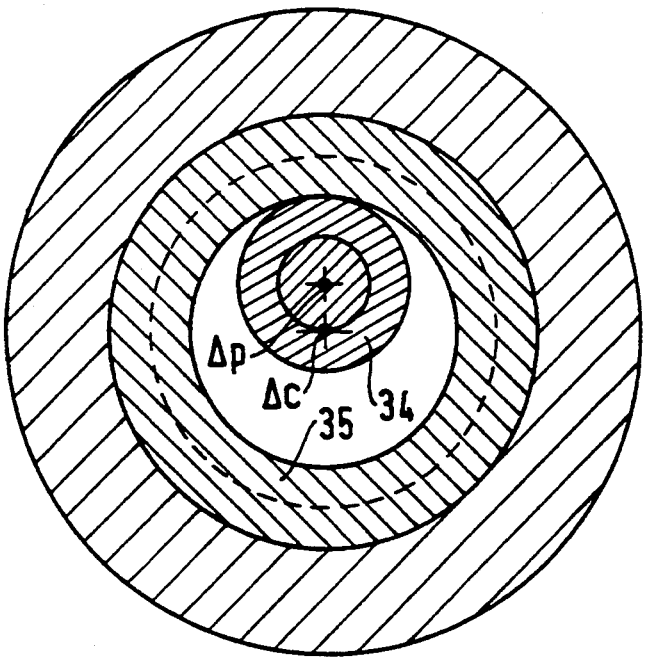
FIG. 10 is a section on X—X of FIG. 8.

FIGS. 8, 9, and 10 show a variant embodiment.

In the preceding figures, since the profile $P_2$ of the casing is the envelope of the piston in its motion produced when the circle $C_1$ tied to the piston is rolling without slip inside the circle $C_2$, the slip-free rolling circles $C_1$ and $C_2$ tied respectively to the piston and to the casing, and defining the motion of the piston inside the casing have respective radii $R_1=S_pE$ and $R_2=S_cE$, are physically embodied by the wheel 3 and by the bore 8, and they are too small to enable electrical windings to be received on the support 7 in which the bore is provided. In the examples shown in those figures, in order to impart the motion, it is necessary to provide a toothed ring 6 that has a large diameter so that drive windings 20 can be received therein, and to associated the toothed ring with a sprocket 2 (or a toothless ring 28). The hole 29 provided in the sprocket 2 (or in the toothless ring 28) has a diameter that is large enough to ensure that, when the sprocket (or the toothless ring) is in motion, it does not touch the outer periphery of the support 7 in which the bore 8 is provided. The toothed ring 6 and the sprocket 2 (or the toothless ring 28) are coplanar with the wheel 3 and the support 7, as can be seen in FIG. 4.

However, if the radii of the circles $C_1$ and $C_2$, which radii have the following values: $R_1=S_pE$ and $R_2=S_cE$, are large enough, the construction may be a little different: the drive portion: toothed ring/sprocket (toothless ring) may then correspond to the slip-free rolling circles $C_1$ and $C_2$. In practice rolling rings and rolling paths are used having dimensions that correspond exactly to the radii $R_1$ and $R_2$, whereas there is a very small amount of clearance between the drive toothed ring and the sprocket.

FIGS. 8 to 10 show such a construction for a large machine in which the eccentricity E between the axes $\Delta_p$ and $\Delta_c$ is large.

In FIGS. 8 to 10, the end of the piston 1 is provided with a ferromagnetic sprocket 30 having $N_p$ teeth 31, while the stator portion is provided with a ferromagnetic toothed ring 32 provided with $N_B$ windings 33, where $N_p/N_B=S_p/S_c$, On either side of the sprocket 30, a rolling ring 34 is mounted having a radius $R_1=S_pE$, and on either side of the toothed ring 32, a rolling path 35 is mounted having a radius $R_2=S_cE$. The radius of the sprocket 30 and the radius of the toothed ring 32 are such that there is a small amount of clearance on the generator line corresponding at all times to rolling contact without slip between the rolling rings 34 and the rolling paths 35. The machine further carries an axial abutment constituted by two magnetized rings 36 and 37, namely a magnetized ring 36 carried by the rotor assembly, and another magnetized ring 37 carried by the stator assembly.

Figure 11:
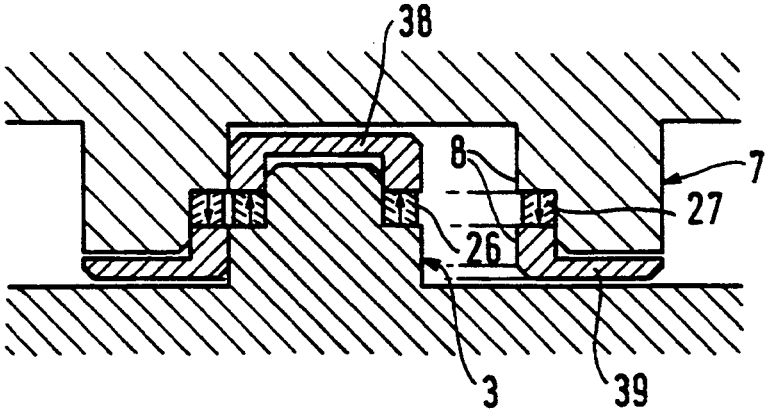
FIGS. 11, 12, and 13 show three variants of a portion of FIG. 4.
Figure 12:
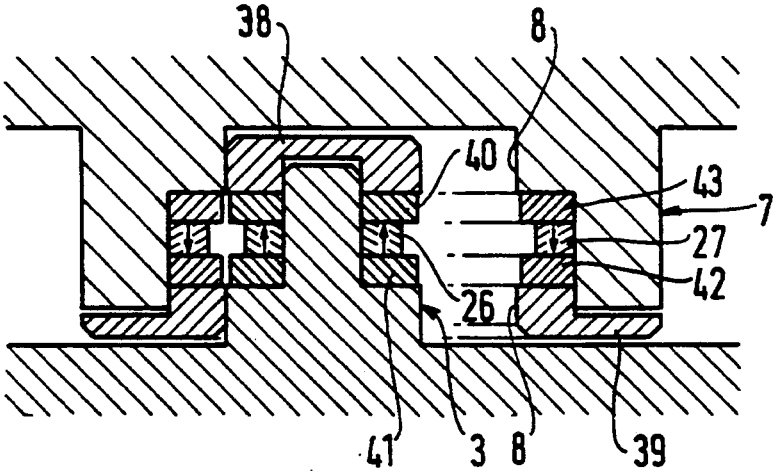
Figure 13:
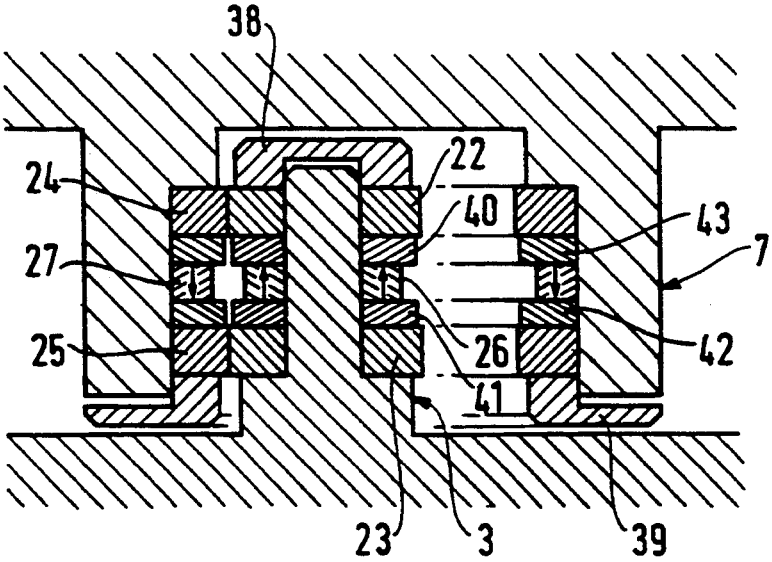

FIGS. 11, 12, and 13 show three variant embodiments of the rolling members for enabling the wheel 3 to roll inside the bore 8, and of the axial abutment carried by the same elements.

Figure 4:
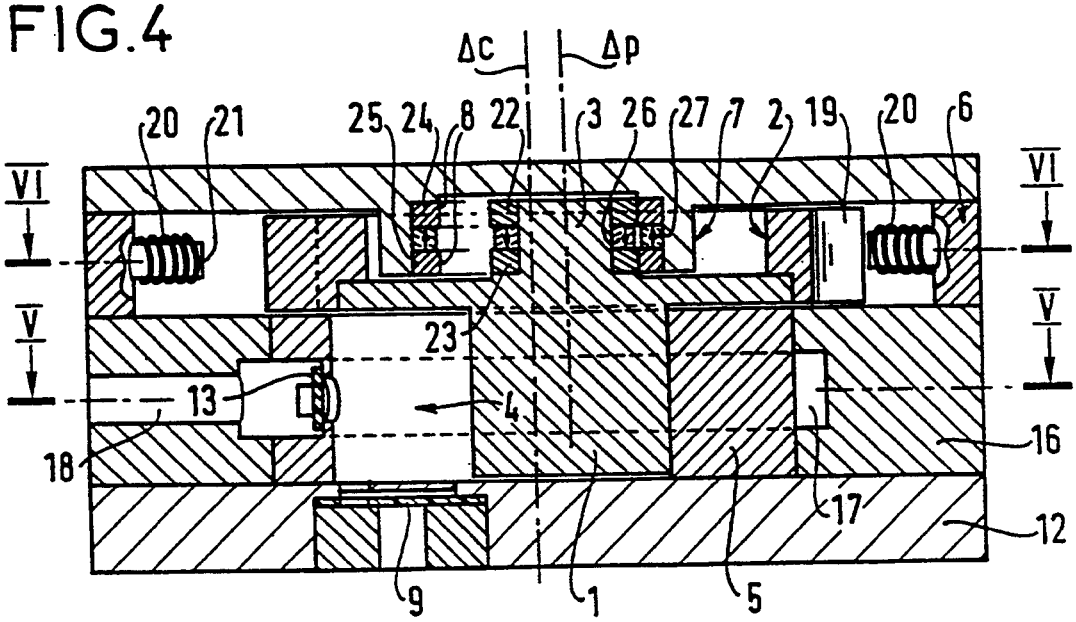
FIG. 4 is a diagrammatic section view through a machine of the invention on a plane containing the two axes $\Delta_p$ and $\Delta_c$.

In FIG. 4, the rolling members 22, 23, 24, 25 are attached so as to flank the magnetized rings 26, 27 of the axial abutment.

In FIG. 11, there are no attached rolling rings. The magnetized ring 26 is mounted on the wheel which is clamped between a shoulder and a cap 38. In the same way, the magnetized ring 27 is mounted in the support 7 between a shoulder and a cover In FIG. 12, as in FIG. 11, there are no attached rolling rings. Rolling takes place directly on the rectified surfaces of the wheel 3 and of the bore 7. In this example, the magnetized rings are flanked by ferromagnetic rings: 40 & 41 for the wheel 3, and 42 & 43 for the support 7. The rings are slightly set back relative to the rolling surfaces. The assembly comprising the magnetized rings and the ferromagnetic rings constitutes a passive magnetic abutment having reluctance.

In FIG. 13, as in FIG. 4, there are rolling rings 22, 23, 24, and 25, and also, as in FIG. 12, ferromagnetic rings 40, 41, 42, and 43.

We claim:

1. A positive-displacement machine having orbital motion and including a piston which is cylindrical in the mathematical sense, which has an axis $\Delta_p$, which is rotary, and which is situated in a cylindrical casing that has an axis $\Delta_c$, said piston having a cross-section that has $S_p$ axes of symmetry in a plane perpendicular to its axis $\Delta_p$, said casing delimiting a hollow volume whose cross-section in a plane perpendicular to its axis $\Delta_c$ has $S_c$ axes of symmetry, $S_p$ and $S_c$ differing from each other by unity, the axes $\Delta_p$ and $\Delta_c$ being parallel and separated by a distance E, the piston and the casing delimiting at least three chambers between them, and the casing including at least one suction inlet and one delivery outlet, wherein said positive-displacement machine further includes a ferromagnetic sprocket which has an axis $\Delta_p$, which is secured to the piston, which has $N_p$ teeth, and which is disposed inside a ferromagnetic toothed ring which has an axis $\Delta_c$ and which is secured to the casing, said toothed ring being provided with $N_B$ electrical windings disposed radially, wherein the ratio $N_p/N_B$ is equal to the ratio $S_p/S_c$, and wherein the $N_B$ electrical windings of said toothed ring are powered successively.

2. A positive-displacement machine according to claim 1, further including a wheel which has an axis $\Delta_p$, which is secured to the piston, and which has a radius $R_1=S_pE$, said wheel being disposed inside and rolling without slip inside a circular bore which has an axis $\Delta_c$ and is provided in a support that is secured to said toothed ring, the bore having a radius $R_2=S_cE$.

3. A positive-displacement machine according to claim 1, wherein a rolling ring of radius $R_1=S_pE$ is situated on each side of said ferromagnetic sprocket, and a rolling path of radius $R_2=S_cE$ is situated on each side of said ferromagnetic toothed ring, the radii of said sprocket and of said toothed ring being such that there is a small amount of clearance between the sprocket and the toothed ring on the generator line corresponding at all times to rolling contact without slip between said rolling ring and said rolling path.

4. A positive-displacement machine having orbital motion and including a piston which is cylindrical in the mathematical sense which has an axis $\Delta_p$ which is rotary and which is situated in a cylindrical casing that has an axis $\Delta_c$, said piston having a cross-section that has $S_p$ axes of symmetry in a plane perpendicular to its axis $\Delta_p$, said casing delimiting a hollow volume whose cross-section in a plane perpendicular to its axis $\Delta_c$ has $S_c$ axes of symmetry, $S_p$ and $S_c$ differing from each other by unity, the axes $\Delta_p$ and $\Delta_c$ being parallel and separated by a distance E, the piston and the casing delimiting at least three chambers between them, and the casing including at least one suction inlet and one delivery outlet, wherein said positive-displacement machine further includes a ferromagnetic collar which has an axis $\Delta_p$, which has an outside diameter $D_1$, which is secured to the piston, and which is disposed inside a ferromagnetic toothed ring which has an axis $\Delta_c$, which has an inside diameter $D_2$, and which is secured to the casing, said toothed ring being provided with a plurality of electrical windings disposed radially and powered successively, the ratio $D_1/D_2$ being different from the ratio $S_p/S_c$, a small amount of clearance existing between those respective generator lines of the collar and of the toothed ring which are closest together and which are situated in the plane containing the axes $\Delta_p$ and $\Delta_c$, and wherein the machine further includes a wheel which has an axis $\Delta_p$, which is secured to the piston, and which has a radius $R_1=S_pE$, said wheel being disposed and rolling without slip inside a circular bore which has an axis $\Delta_c$, and which is provided in a support that is secured to said toothed ring, the bore having a radius $R_2=S_cE$.

5. A positive-displacement machine according to claim 2, including an axial magnetic abutment composed of at least one pair of magnetized rings, one of which is secured to said support, and the other of which is secured to said wheel.

6. A positive-displacement machine according to claim 1, wherein, in a plane perpendicular to its axis $\Delta_p$, said piston has a cross-section that is hypertrochoidal in geometrical shape, and wherein said casing delimits a hollow volume whose cross-section in a plane perpendicular to its axis $\Delta_c$ is hypertrochoidal in geometrical shape.

7. A positive-displacement machine according to claim 4, including an axial magnetic abutment composed of at least one pair of magnetized rings, one of which is secured to said support, and the other of which is secured to said wheel.

8. A positive-displacement machine according to claim 4, wherein, in a plane perpendicular to its axis $\Delta_p$, said piston has a cross-section that is hypertrochoidal in geometrical shape, and wherein said casing delimits a hollow volume whose cross-section in a plane perpendicular to its axis $\Delta_c$ is hypertrochoidal in geometrical shape.

* * * * *